US005159310A

United States Patent [19]

Cummins et al.

[11] Patent Number: 5,159,310

[45] Date of Patent: Oct. 27, 1992

[54] RESISTOR GRID HEAT DISSIPATING ASSEMBLY

[75] Inventors: Robert Cummins, Pittsburgh, Pa.; Victor V. Kirilloff, Lincoln, Nebr.; William A. Benson; Richard S. Dawson, both of Pittsburgh, Pa.

[73] Assignee: Mosebach Manufacturing Company, Pittsburgh, Pa.

[21] Appl. No.: 710,337

[22] Filed: Jun. 5, 1991

Related U.S. Application Data

[63] Continuation-in-part of Ser. No. 465,323, Jan. 16, 1990, Pat. No. 5,049,852.

[51] Int. Cl.[5] ..... H01C 1/01; H01C 3/00

[52] U.S. Cl. ..... 338/280; 338/51; 338/281; 338/321; 338/317; 338/290

[58] Field of Search ..... 338/280, 281, 283, 277, 338/279, 290, 315, 317, 321; 219/542, 539

[56] References Cited

U.S. PATENT DOCUMENTS 4,051,452 9/1977 Luy ..... 338/51
5,045,831 9/1991 Kirilloff et al. ..... 338/280
5,049,851 9/1991 Kirilloff et al. ..... 338/280

*Primary Examiner*—Marvin M. Lateef
*Attorney, Agent, or Firm*—Buchanan Ingersoll; George Raynovich, Jr.

[57] ABSTRACT

A heat dissipating resistor grid has a rectangular or annular frame including side members carrying blocks or panels of insulating material having cavities in their inner surfaces. The resistor element is a zigzag strip formed from individual flat lengths of resistance material, each length having offset ends in opposite directions, adjoining offset ends forming a sandwich with a conductive support strip which extends beyond the offset end and terminates in projections which mate with the cavities in the insulating material. The support strip may extend into the space between the adjoining strips of resistance material forming a heat sink therein. The projecting ends of the support strip may be flat lengths, may be cut into tabs, may be formed into hollow cylinders in one piece with the support strip, may be solid cylindrical studs affixed to the support strip, or solid rod bent into U-shape with the base inside the offset ends. The insulating blocks may fit into cutouts in the frame and lock there by lateral movement.

15 Claims, 7 Drawing Sheets

RESISTOR GRID HEAT DISSIPATING ASSEMBLY

This application is a continuation-in-part of our application Ser. No. 465,323, filed Jan. 16, 1990, now U.S. Pat. No. 5,049,8 issued on Sep. 17,1991

Our invention relates to resistors used for dynamic braking in diesel-electric locomotives. It is more particularly concerned with such a fabricated resistor grid assembly having a novel heat dissipating construction which makes possible the use of organic or other inexpensive insulation between the resistor element and the frame of the grid.

BACKGROUND OF THE INVENTION

The braking of diesel electric locomotives conventionally involves the shunting of the motor terminals with a resistor or bank of resistors. When that is done, the motors, driven by the moving locomotives, act as generators and the current they generate passes through the shunt resistors. The resistor converts the current into heat which in turn must be dissipated. Conventionally the resistor comprises a folded or zigzag strip or strips of resistance material mounted in a metal frame. That strip may be a unitary fan-folded strip, as is shown in Kirilloff et al. 4,109,526 and 4,651,124, or a fabricated zigzag strip such as is shown in Harkness 4,651,125 and 4,654,627.

SUMMARY OF THE INVENTION

Our invention utilizes a zigzag resistor element mounted in a rectangular or annular frame, the element being made up of individual strips of resistance material, each strip having an offset at each end in opposite directions. Each offset end portion is joined to the end of the adjoining strip offset in the opposite direction through a third strip element or tab which projects between the offset ends and at its outside end is configured to mate with a hole or cavity in a body of insulating material carried by the side element of the frame. This third element may be thicker than the resistor strip and may project inwardly between the undivided strips so as to form a heat sink.

PREFERRED RECTANGULAR FRAME MODE

Figure 1:
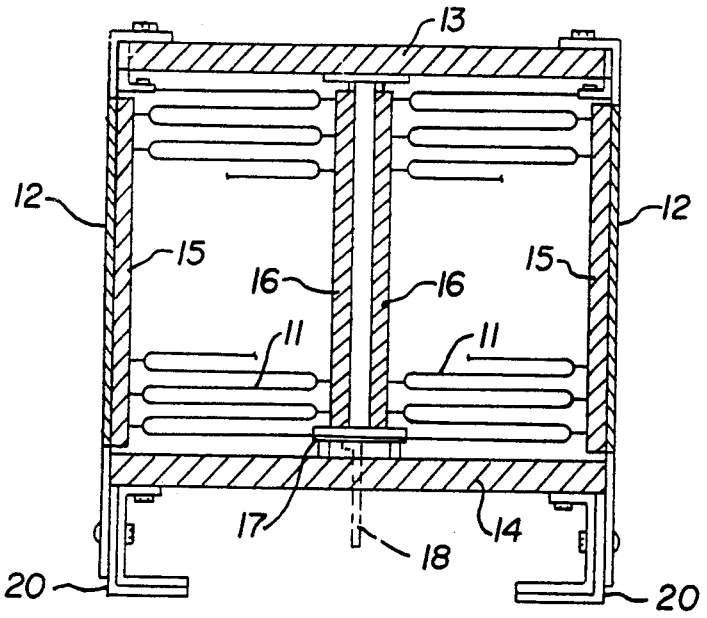
FIG. 1 is an elevation of our resistor grid assembly mounted in a rectangular frame.

In FIG. 1, the resistor strips 11—11, to be described hereinafter, are mounted in a frame having metal end pieces 12—12, one on each side, a top panel 13 and bottom panel 14. Those panels may be made of insulating material. Affixed to the inside faces of end pieces 12 are panels 15—15 of insulating material. Midway between panels 15—15 are a pair of insulating panels 16—16, spaced from each other and affixed to top panel 13 and to bottom panel 14 through a metal plate 17, which has a downwardly extending tap 18 projecting through bottom panel 14. The resistor strips 11—11 at their upper ends are attached to end pieces 12—12; at their lower ends they are attached to metal plate 17. The lower ends of end panels 12—12 extend below bottom panel 14 into metal angles 20—20 which with tap 18 are the electrical connections of the grid. The resistor strips 11—11 are supported at their ends adjacent panels 15—15 and 16—16 by means to be described hereinafter.

Figure 2:
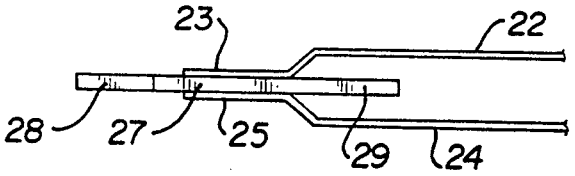
FIG. 2 is a detail in elevation of one embodiment of the offsets of the individual strips and tabs of our invention.
Figure 3:
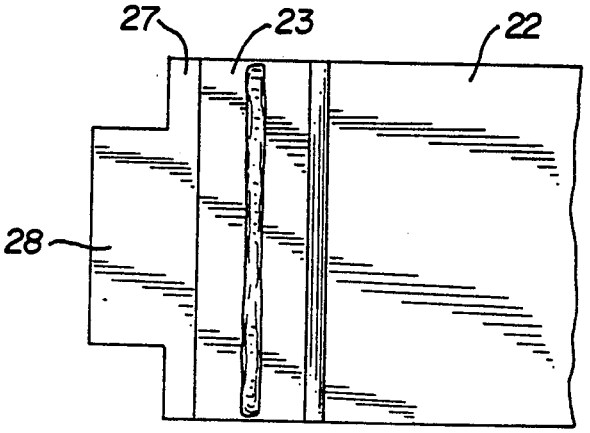
FIG. 3 is a plan of the elevation shown in FIG. 2.

The resistor strips 11—11, which form a zigzag path between terminals 20—20 and tap 18 are fabricated from flat strips 22 of resistor material, each strip offset at one end 23, as appears in FIGS. 2 and 3 and offset at the other end, not shown, in the opposite direction. Its adjoining parallel strip 24, at its end 25 opposite end 23, is offset toward end 23. Between offset ends 23 and 25 we position a metal supporting strip or plate 27 which may exit at both ends parallel to strips 22 and 24 beyond those offsets. Outer end 28 of plate 27 is formed into a tab which fits into a mating recess 30 in insulator panel 15 or 16, as will be described hereinafter; inner end 29 may extend into the space between strips 22 and 24 of resistor material. Offset ends 23, 25 and strip 27 are joined, preferably by resistance welding, as indicated in FIG. 3. Tab 28 supports the resistor strip in its frame. Plate 27 may be made of thicker or more heat conductive material than resistance strips 22 and 24 and so acts as a heat sink to reduce the heat transfer from the resistor strip 11 to the panels of insulating material 15 or 16. This structure makes feasible the use of less expensive insulating materials.

Figure 4:
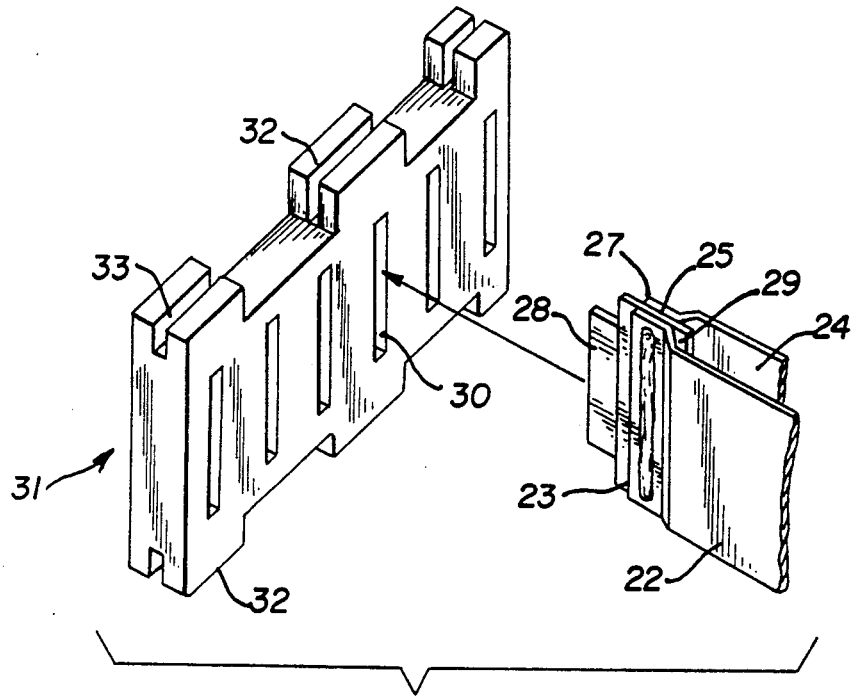
FIG. 4 is an exploded isometric showing the mating of the projecting tab or third element of FIG. 2 with recesses in a block of insulating material.
Figure 5:
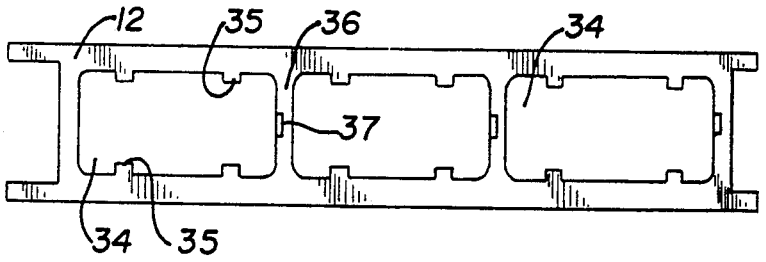
FIG. 5 is a detail of a supporting plate for the insulating block of FIG. 4.

FIG. 4 illustrates a block 31 of insulating material adapted to receive tab 28 in a cavity 30 and FIG. 5 shows a metal end piece 12 adapted to receive a succession of blocks 31. Those blocks are formed with projections 32 along their sides which have aligned longitudinal channels or grooves 33 therein of a width sufficient to accept end pieces 12. Those end pieces 12 have rectangular openings 34, separated by cross members 36 with internally projecting extensions 35 on each side, spaced from each other so as to fill the spaces between projections 32 of block 31. The overall length of each block 31 is slightly less than the longitudinal dimension of each opening 34. After block 31 is moved broadside into opening 34, it is moved longitudinally sufficiently to cause extensions 35 to enter channel 33. Each member 36 has a small tang 37 projecting normal to that member, which tang is then bent over toward adjoining block 31 so as to prevent it from moving longitudinally in the opening 34. With that construction a damaged block 31 can be replaced without dismantling the entire grid, which simplifies maintenance of a grid utilizing brittle insulating material. With less fragile insulating material it is convenient to use a strip or panel 15, FIG. 1, of insulating material extending the length of the end pieces 12 and formed with cavities 30 mating with tabs 28 of the resistor element.

Figure 6:
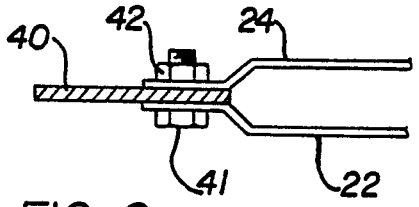
FIG. 6 is a detail of a structure similar to FIG. 2 but fabricated with a bolt and nut.
Figure 7:
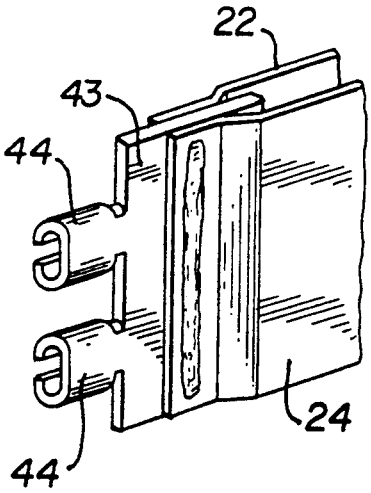
FIG. 7 is an isometric view of another embodiment of the tabs of our invention.
Figure 8:
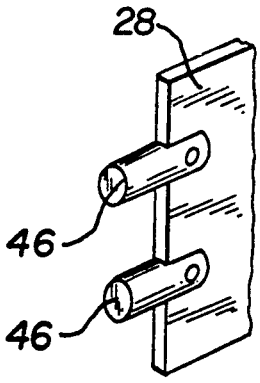
FIG. 8 is an isometric view of still another embodiment of the tabs of our invention.
Figure 9:
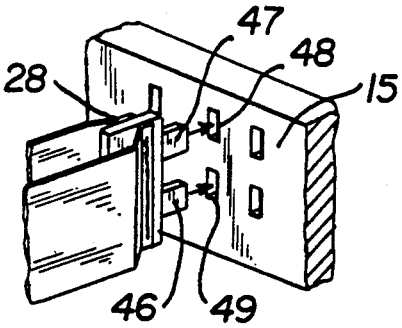
FIG. 9 is an isometric view of yet another embodiment of the tabs and insulating block of our invention.
Figure 10:
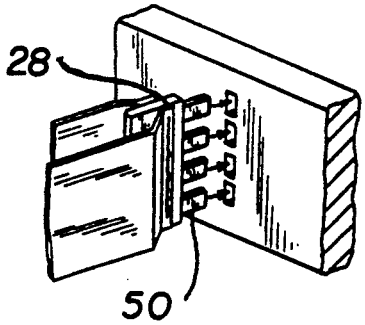
FIG. 10 is a detail of a modification of the structure of FIG. 9 of our invention.

The tabs and cavities above mentioned may take other forms than those described above. FIG. 6 illustrates a flat tab 40 affixed to the offset ends of individual resistor strips 22 and 24 by a bolt 41 and a nut 42. FIG. 7 illustrates a flat tab 43 welded to its adjoining resistor strips and having its outer end formed into two cylindrical studs 44 which can be received by round holes in a joining insulating material. FIG. 8 illustrates a flat tab 28, as described hereinabove, but with two cylindrical studs 46 affixed to its outer end by welding or riveting. FIG. 9 shows a flat tab 28 with its outer end subdivided into two rectangular projections 46 and 47 which fit into properly contoured spaced openings 48 and 49 in an insulating panel 15. FIG. 10 is similar to FIG. 9 but with the tab 28 subdivided into four projections 50 which would require four rectangular cavities in the insulating panel. In both FIGS. 9 and 10 the projections are shown as rectangular in cross section but they may be cylindrical, as shown in FIGS. 7 and 8.

Figure 11:
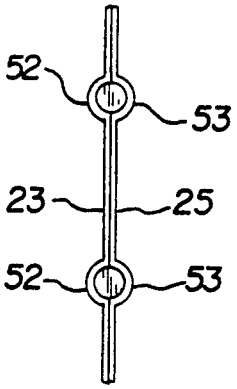
FIG. 11 is an end elevation of the embodiment of FIG. 13.
Figure 12:
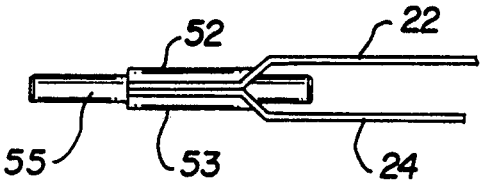
FIG. 12 is a side elevation of the embodiment of FIG. 11.
Figure 13:
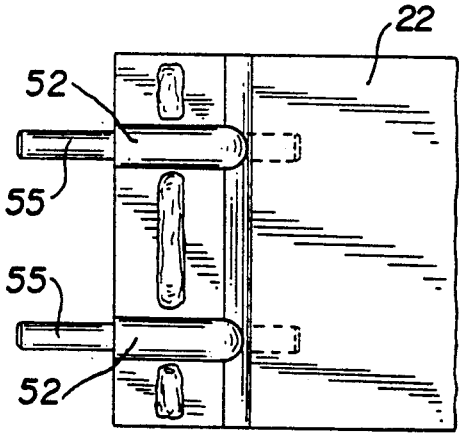
FIG. 13 is a plan of a modification of the embodiments of FIGS. 7 and 8.

FIGS. 11, 12 and 13 illustrate yet another form of tab. Instead of a flat supporting strip 27 between offset ends 23 and 25 of the grid elements, those ends are each formed with a pair of longitudinal half channel depressions 52 and 53 which, when ends 23 and 25 are welded or otherwise fastened together, form two cylindrical sleeves. In those sleeves are inserted short lengths of round rods 55 so that they project beyond the outside ends of the grid elements and, if desired, into the space between resistor elements 22 and 24. The outer ends of rods 55 serve the same purpose as the studs 46 of FIG. 8 or cylindrical studs 44 of FIG. 7. The inner ends, if required, act as heat sinks in the manner of inner ends of element 29 in FIG. 4.

Figure 14:
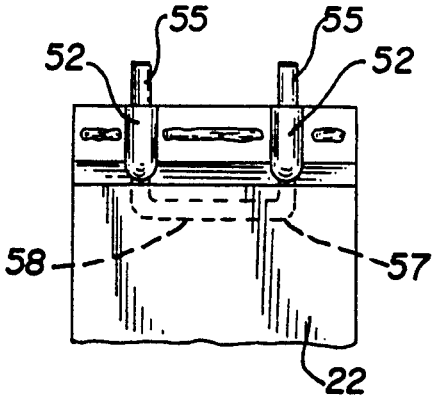
FIG. 14 is a plan of a modification of FIG. 13.

FIG. 14 is a modification of the articles of FIG. 13. The offset ends of the resistor strip are formed into a pair of longitudinal half-channel depressions 52 and 53, as before. A single U-shaped piece of rod 57 is formed with legs 55 fitting into the cylindrical sleeves formed by the welded half-channel depressions 52 and 53 and is inserted from the inside end of those sleeves so that its legs project from the outside ends of the sleeves a distance sufficient to engage mating cavities in the insulating blocks or panels hereinbefore described. The crossbar 58 of the U-shaped rod 57 forms a substantial heat sink.

Figure 15:
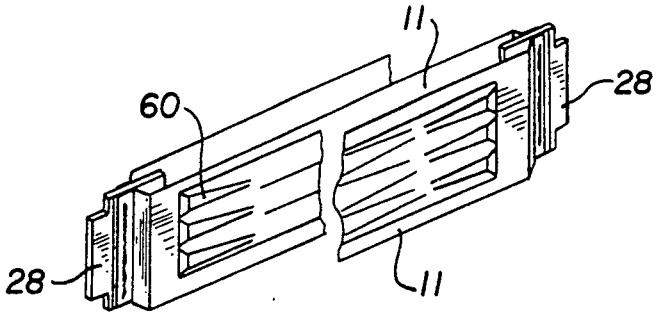
FIG. 15 is an isometric of our invention with embossed resistance strip.

In FIG. 15 the lengths of resistor material 11—11 form sandwiches at their offset ends with supporting member 28. The strips 11 are flat strips but are embossed longitudinally at 60 to stiffen them.

Figure 16:
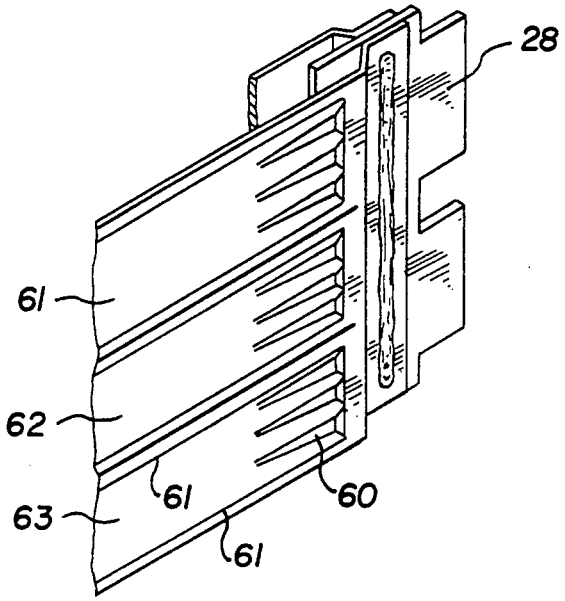
FIG. 16 is an isometric of our invention with embossed and lanced resistor strip.

In FIG. 16 multiple embossed at 60 and lanced at 65 strips of resistor material are sandwiched at each end with supporting member 28. Three strips, 61, 62 and 63, are shown welded at their ends to support member 28. Each strip is embossed at its end adjoining member 28 with indentations 60 and is lanced or severed between ends at 65–65, as are shown.

Figure 17:
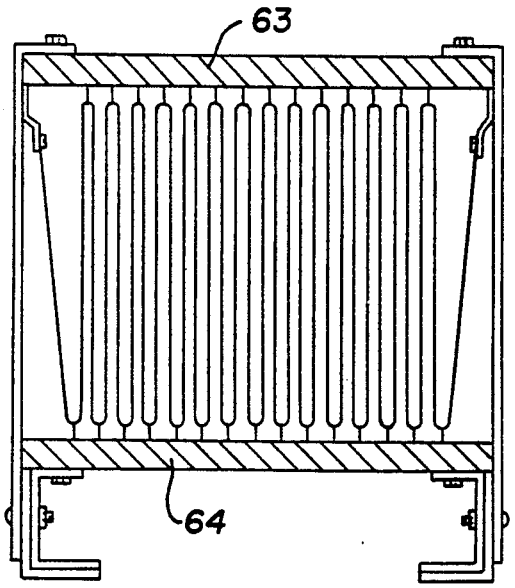
FIG. 17 is an elevation of a vertical grid resistor embodying our invention.

FIG. 17 illustrates diagrammatically how our invention may be embodied in a vertical grid resistor. The recesses shown in FIGS. 4, 9 and 10, for example, can be incorporated in the horizontal members 63–64, rather than the vertical members of FIG. 1.

PREFERRED ANNULAR FRAME MODE

Figure 18:
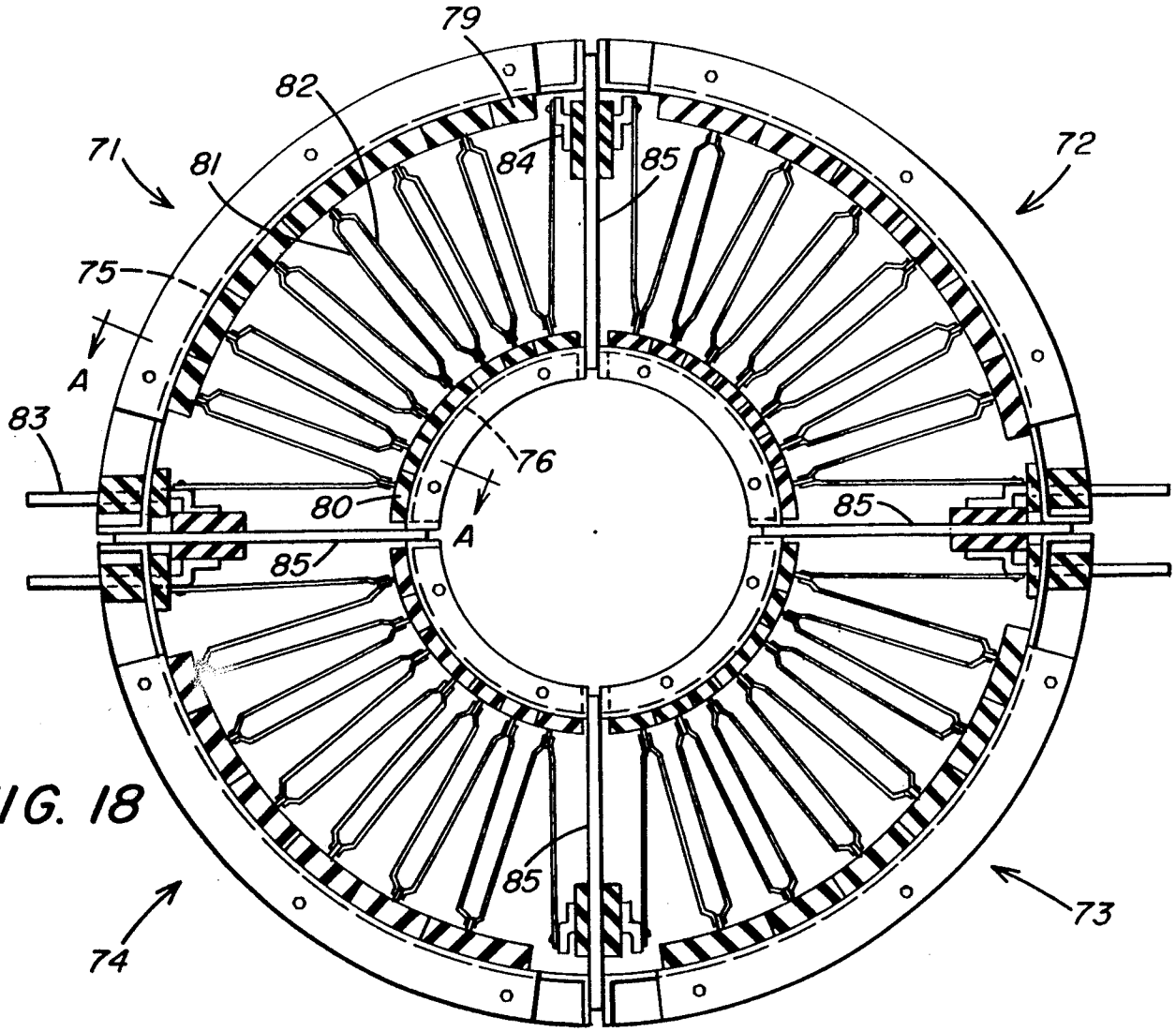
FIG. 18 is a plan of our resistor grid assembly mounted in an annular frame.

The annular grid of FIG. 18 is formed of four quadrants 71, 72, 73 and 74, each having an arcuate outside wall identified for quadrant 71 as 75, and an inside wall 76 of considerably shorter radius. The axial dimensions of the quadrants may be sufficient to accommodate several levels of resistor ribbon as is shown in FIG. 19, which levels preferably would be of identical resistance and would be connected in series or parallel as required.

Figure 19:
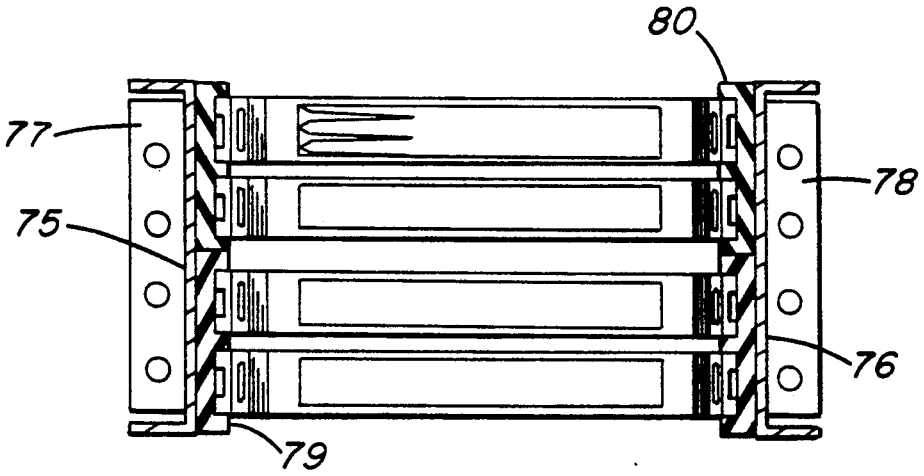
FIG. 19 is a section through FIG. 18 taken on the plane A—A, showing four levels of resistor ribbon.
Figure 20:
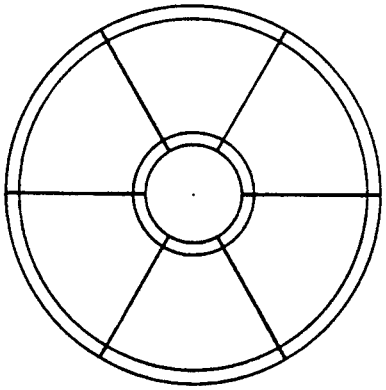
FIG. 20 is a diagrammatic plan of an annular frame resistor grid divided into six sections.

Outside and inside walls 75 and 76 have flanges 77 and 78 respectively at the ends of the quadrants which are fastened by bolts or otherwise to the corresponding end flanges of adjoining quadrants 71 and 74 respectively as may be seen in FIG. 19. Those quadrants are attached to the free ends of quadrants 72 and 73 to complete the annular resistor frame. Outside and inside arcuate walls, such as 75 and 76, are spaced from each other by flat structural members 85, the outer and inner ends of which are held between the end flanges of adjoining outer quadrant walls and inner quadrant walls respectively, by bolts or otherwise. To the inside faces of walls 75 and 76 are affixed blocks of insulating materials 79 and 80 respectively as shown in FIGS. 18 and 19. Those blocks of insulating material are curved to fit the walls 75 and 80.

The zigzag strip of resistor material is formed in the same way as has been described hereinabove for a rectangular frame, having offset ends at each length forming a sandwich with a support strip terminating in projections which mate with cavities in the blocks of insulating material 79 and 80. The various forms are those shown in FIGS. 2, 3, 4 and 6 through 14 herein.

The zigzag strips 81 and 82 in quadrants such as 71 of the grid of FIG. 18, however, differ from strips 11—11 in FIG. 1 in not being parallel to each other. They are closer together at their ends near insulating blocks 80 than they are at insulating blocks near ends 79. The ends of the resistor strip in quadrant 71 are attached to terminals 83 and 84 respectively at their ends. Those terminals are insulated from the quadrant walls 85 and may be connected in series or parallel or to outside electrical sources as desired.

We claim:

1. An improved fabricated resistor grid having a frame including a pair of oppositely positioned conducting members and a zigzag resistor comprising flat individual strips of resistance material positioned opposite each other, each strip having an offset portion at each end, said offset portions being parallel to each other and extending in opposite directions, each offset portion being joined to the opposite direction offset portion of the adjoining strip so as to form a current path between the said conducting members, the improvement comprising a short supporting member of conductive material of a gauge at least equal to that of said strip forming a sandwich between each of said joined offset portions and projecting outwardly therefrom, parallel to said offset portions, and a block of insulating material carried by said conductive members having recesses in its inner surface adapted to mate with said outwardly projecting supporting members.

2. The fabricated resistor grid of claim 1 in which said sandwich is held together by a resistance weld between said short supporting member and said adjoining offset portions.

3. The fabricated resistor of claim 1 in which said sandwich is held together by a nut and bolt in compression; said bold extending through said short supporting member and said adjoining offset portions.

4. The fabricated resistor grid of claim 1 in which said supporting strip of conductive material extends inwardly between said parallel strips.

5. The fabricated resistor grid of claim 1 in which the outwardly projecting end of said supporting strip is divided into parallel segments.

6. The fabricated resistor grid of claim 1 in which the outwardly projecting end of said supporting strip terminates in outwardly extending solid cylindrical studs.

7. The fabricated resistor grid of claim 1 in which the outwardly projecting end of said supporting strip terminates in outwardly extending hollow cylindrical studs.

8. The fabricated resistor grid of claim 1 in which said block of insulating material fits into an opening in said structural member, said opening having a greater length than said block with spaced projections on each side of said block that overlap inwardly extending spaced projections from said structural member in said opening when said block is at one end of said opening and do not overlap said inwardly extending projections when said block is at the other end of said opening.

9. The fabricated resistor grid of claim 1 in which said joined offset portion is formed to include cylindrical passages therethrough and said cylindrical passages are filled by solid cylindrical elements which project beyond said offset portions so as to mate with recesses in said block of insulating material.

10. The fabricated resistor of claim 9 in which said solid cylindrical elements project inwardly beyond said offset portions between said parallel strips.

11. The fabricated resistor grid of claim 9 in which said solid cylindrical elements are the ends of a U-shaped cylindrical bar, the cross piece of which bar is positioned within said offset portion.

12. The fabricated resistor grid of claim 1 in which said strips of resistance material are embossed longitudinally so as to stiffen them.

13. The fabricated resistor grid of claim 1 in which said strips of resistance material are lanced or severed longitudinally between said offset portions.

14. The fabricated resistor grid of claim 1 in which the frame is a rectangular frame having a top member and a bottom member each connected to said oppositely positioned conducting members.

15. The fabricated resistor grid of claim 1 in which the frame is an annular frame.

* * * * *

UNITED STATES PATENT AND TRADEMARK OFFICE

CERTIFICATE OF CORRECTION

PATENT NO. : 5,159,310

DATED : October 27, 1992

INVENTOR(S) : ROBERT CUMMINS, VICTOR KIRILLOFF, WILLIAM BENSON RICHARD DAWSON

It is certified that error appears in the above-identified patent and that said Letters Patent is hereby corrected as shown below:

On the title page, insert --The term of this patent subsequent to September 16, 2008 has been disclaimed by the assignee of record.--

Column 1, line 6, change "5,049,8" to --5,049,852--.

Column 4, line 58, claim 1, change "a" to --an annular--.

Column 6, cancel claims 14 and 15.

Signed and Sealed this

Thirty-first Day of May, 1994

*Attest:*

*Attesting Officer*

Bruce Lehman

BRUCE LEHMAN

*Commissioner of Patents and Trademarks*